US010032583B2

(12) United States Patent
Furuuchi et al.

(10) Patent No.: US 10,032,583 B2
(45) Date of Patent: Jul. 24, 2018

(54) PROTECTIVE CIRCUIT SUBSTRATE

(71) Applicant: DEXERIALS CORPORATION, Tokyo (JP)

(72) Inventors: Yuji Furuuchi, Nikko (JP); Takashi Fujihata, Kanazawa (JP); Koichi Mukai, Utsunomiya (JP)

(73) Assignee: DEXERIALS CORPORATION, Tokyo (JP)

( * ) Notice: Subject to any disclaimer, the term of this patent is extended or adjusted under 35 U.S.C. 154(b) by 0 days.

(21) Appl. No.: 15/045,584

(22) Filed: Feb. 17, 2016

(65) Prior Publication Data

US 2017/0236665 A1 Aug. 17, 2017

(51) Int. Cl.
*H01H 37/04* (2006.01)
*H01H 37/34* (2006.01)
*H01H 37/76* (2006.01)

(52) U.S. Cl.
CPC ..... *H01H 37/04* (2013.01); *H01H 37/34* (2013.01); *H01H 37/761* (2013.01)

(58) Field of Classification Search
CPC ..... H01H 37/04; H01H 37/761; H01H 37/34; H01H 85/046
See application file for complete search history.

(56) References Cited

U.S. PATENT DOCUMENTS 6,809,626 B2 * 10/2004 Chu ..... H01C 1/1406 337/167
2005/0140491 A1 * 6/2005 Uehara et al. ..... H01H 37/76 337/401
2010/0328020 A1 * 12/2010 Wiryana et al. ..... H01H 85/14 337/232

(Continued)

FOREIGN PATENT DOCUMENTS

JP 2000-173427 A 6/2000
JP 2000-285777 A 10/2000

(Continued)

OTHER PUBLICATIONS

Yoneda Yoshihiro, Protective Element, Nov. 7, 2013, Dexerials Corp, Entire Document (Translation of JP 2013229293).*

(Continued)

*Primary Examiner* — Jayprakash N Gandhi
*Assistant Examiner* — Stephen Sul
(74) *Attorney, Agent, or Firm* — Oliff PLC

(57) ABSTRACT

In a protective circuit substrate having a circuit substrate and a protective element, the protective element including: an insulating substrate; a heat-generating element; first and second electrodes laminated on the insulating substrate; a first and second connecting terminals provided on one side edge of a mounting surface to be mounted to the circuit substrate, the first connecting terminals being continuous with the first and second electrodes; a heat-generating element extracting electrode provided in a current path between the first and second electrodes and electrically connected to the heat-generating element; and a meltable conductor provided between the first and second electrodes, wherein the circuit substrate includes a region for mounting the protective element in which no electrode pattern other than a connecting electrode to the protective element is provided.

5 Claims, 12 Drawing Sheets

(56) References Cited

U.S. PATENT DOCUMENTS

| | | | | |
|---|---|---|---|---|
| 2012/0305302 | A1* | 12/2012 | Mizokami | H01C 1/01 174/259 |
| 2013/0323549 | A1* | 12/2013 | Choi et al. | H01M 2/101 429/62 |
| 2014/0240942 | A1* | 8/2014 | Itabashi | H01H 85/0241 361/772 |
| 2015/0130585 | A1* | 5/2015 | Nakajima | H01H 37/761 337/413 |

FOREIGN PATENT DOCUMENTS

| | | | | | |
|---|---|---|---|---|---|
| JP | 2004-22290 | A | | 1/2004 | |
| JP | 2004-185960 | A | | 7/2004 | |
| JP | 2010-003665 | A | | 1/2010 | |
| JP | 2012-003878 | A | | 1/2012 | |
| JP | 2013229293 | A | * | 11/2013 | H01H 37/761 |
| JP | 2015-035280 | A | | 2/2015 | |

OTHER PUBLICATIONS

Feb. 28, 2017 Office Action issued in Japanese Patent Application No. 2013-164517.

* cited by examiner

PROTECTIVE CIRCUIT SUBSTRATE

TECHNICAL FIELD

This invention relates to a protective circuit substrate including a protective element which interrupts a current path when an abnormality such as over-charging and over-discharging occurs.

BACKGROUND ART

Secondary batteries are often provided to users in the form of rechargeable battery packs which can be repeatedly used. In particular, in order to protect users and electronic appliances, lithium ion secondary batteries having a high volumetric energy density typically include several protective circuits incorporated in battery packs for over-charging protection and over-discharging protection to interrupt the output of the battery pack under predetermined conditions.

Some of these protective elements use an FET switch incorporated in a battery pack to turn ON/OFF the output, for over-charging protection or over-discharging protection of the battery pack. However, even in the cases of the FET switch being short-circuited and damaged for some reason, a large current momentarily flows caused by a surge such as a lightning surge, and an abnormally decreased output voltage or an excessively high voltage occurs in an aged battery cell, the battery pack or the electronic appliance should prevent accidents including fire, among others. For this reason, a protective element is used having a fuse which interrupts a current path in accordance with an external signal so as to safely interrupt the output of the battery cell under these possible abnormalities.

As shown in FIGS. 19 (A) and (B), there has been proposed a protective element 80 of a protective circuit for a lithium ion secondary battery in which a meltable conductor 83 is connected as a part of a current path between first and second electrodes 81, 82, and this meltable conductor 83 in the current path is blown by self-heating due to an overcurrent or by a heat-generating element 84 provided in the protective element 80.

In particular the protective element 80 includes an insulating substrate 85, a heat-generating element 84 laminated on the insulating substrate 85 and covered with an insulating member 86, a first and a second electrodes 81, 82 formed on the both ends of the insulating substrate 85, a heat-generating element extracting electrode 88 laminated on the insulating member 86 and overlapping the heat-generating element 84, and a meltable conductor 83 the both ends of which are connected to the first and second electrodes 81, 82, respectively, and the central portion of which is connected to the heat-generating element extracting electrode 88.

In the protective element 80, when an abnormality such as over-charging or over-discharging is detected, current flows through the heat-generating element 84 and the heat-generating element generates heat. The meltable conductor 83 is melted by this heat and gathers on the heat-generating element extracting electrode 88 to interrupt the current path between the first and second electrodes 81, 82.

PRIOR ART LITERATURE

Patent Literature

PLT 1: Japanese Unexamined Patent Application Publication No. 2010-003665

PLT 2: Japanese Unexamined Patent Application Publication No. 2004-185960

PLT 3: Japanese Unexamined Patent Application Publication No. 2012-003878

SUMMARY OF THE INVENTION

Technical Problem

The protective element 80 is mounted by connecting first and second connecting terminals 92, 93 formed on the back surface of an insulating substrate 85 to the first and second connecting electrodes 96, 97 formed on a circuit substrate 95 via half through-holes 90, 91 provided in the first and second electrodes 81, 82. The protective element 80 thus constitutes a part of a current path between the first and second connecting electrodes 96, 97 formed on the circuit substrate 95.

In recent years, since currents flowing through various electronic appliances have been increasing in accordance with increases in capacity and rating of electronic appliances, suppression or dissipation of heat generated by the protective element 80 or circuit substrate 95 is required. In many cases, dissipation is promoted by making electrode patterns formed on circuit substrate 95 wider and thicker and providing dummy electrode patterns in a region onto which the protective element 80 is to be mounted so as to form more electrode patterns having a large heat capacity.

On the other hand, when an abnormality such as over-charging and over-discharging is detected, heat of the heat-generating element should be preferentially conducted to the meltable conductor 83 so that protective element 80 can promptly blow the meltable conductor 83 to interrupt the current path. Therefore, heat-dissipation caused by heat-conduction of the heat of the heat-generating element 84 via the first and second electrodes 81, 82, the first and second connecting terminals 92, 93 or the dummy electrode pattern to surroundings or the circuit substrate 95 would undesirably inhibit the high-speed blowout property of the meltable conductor 83.

An object of the present invention therefore is to provide a protective circuit substrate which can be mounted onto a circuit substrate with controlled heat-dissipation without degrading high-speed blowout property of the protective element.

Solution to Problem

To solve the aforementioned problem, an aspect of the present invention provides a protective circuit substrate having a circuit substrate and a protective element mounted on the circuit substrate, the protective element comprising: an insulating substrate; a heat-generating element formed on the insulating substrate; a first and a second electrodes laminated on the insulating substrate; a first connecting terminal provided on one side edge of a mounting surface of the insulating substrate to be mounted to the circuit substrate, the first connecting terminal being continuous with the first electrode; a second connecting terminal provided on another side edge of the mounting surface, the second connecting terminal being continuous with the second electrode; a heat-generating element extracting electrode provided in a current path between the first and second electrodes and electrically connected to the heat-generating element; and a meltable conductor laminated on a region extending from the heat-generating element extracting electrode to the first and second electrodes and for interrupting the current path between the first electrode and the second electrode by being melted by heat; wherein the circuit substrate includes a mounting region for mounting the protective element in which no electrode pattern other than a connecting electrode to the protective element is provided beneath the protective element.

Advantageous Effects of Invention

The present invention can suppress heat-dissipation from the back surface of an insulating substrate of a protective element by minimizing the area of electrode patterns having a large heat capacity within the mounting region onto which the protective element of the circuit substrate is mounted. The present invention therefore can conduct heat of a heat-generating element to a meltable conductor so as to promptly blow the meltable conductor and interrupt a current path when an abnormality such as over-charging or over-discharging is detected.

DESCRIPTION OF EMBODIMENTS

Figure 1A:
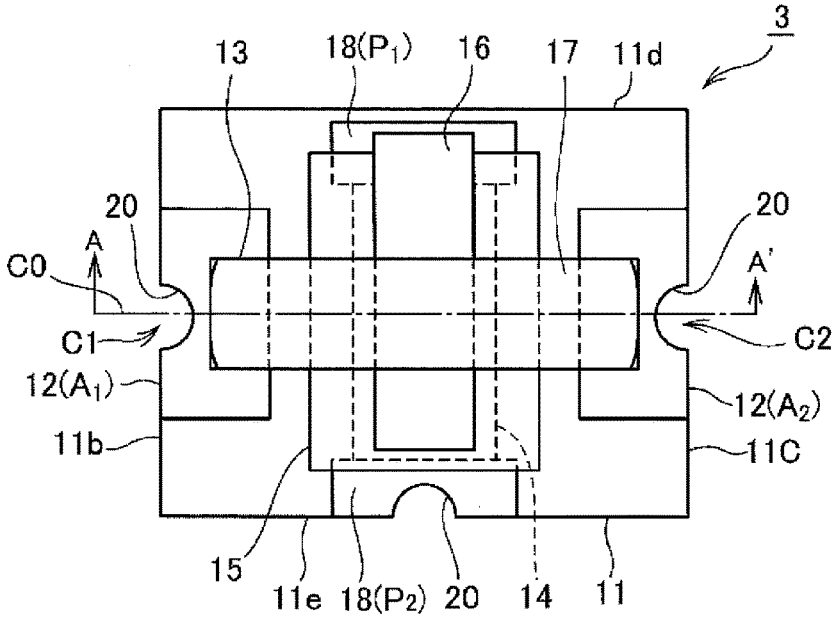
FIG. 1 (A) is a plan view illustrating a protective element of a protective circuit substrate according to an embodiment of the present invention and FIG. 1 (B) is an A-A' cross-sectional view of the protective circuit substrate.

Embodiments of protective circuit substrates according to the present invention will now be more particularly described with reference to the accompanying drawings. It should be noted that the present invention is not limited to the embodiments described below and various modifications can be added to the embodiment without departing from the scope of the present invention. The features shown in the drawings are illustrated schematically and are not intended to be drawn to scale. Actual dimensions should be determined in consideration of the following description. Moreover, those skilled in the art will appreciate that dimensional relations and proportions may be different among the drawings in some parts.

Protective Circuit Substrate

Figure 1B:
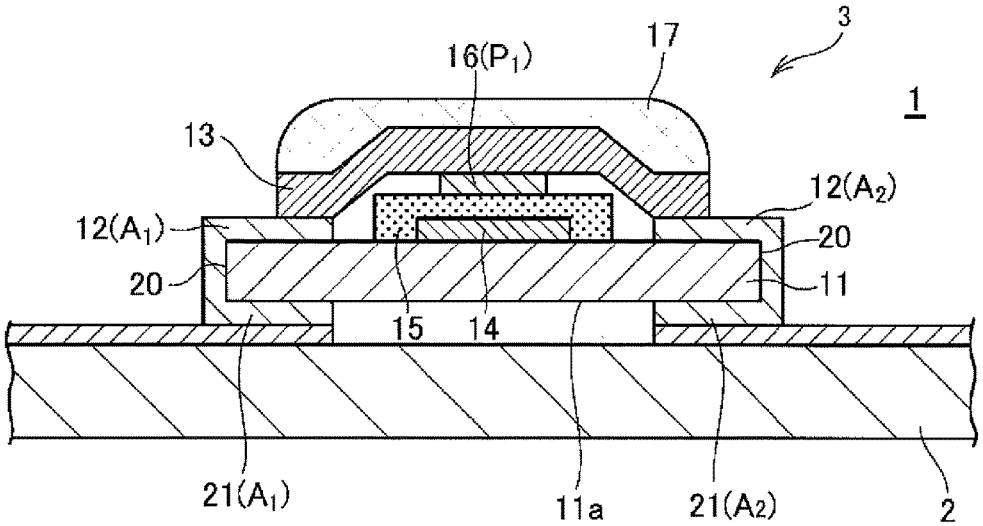

FIG. 1 shows a protective circuit substrate 1 according to the present invention including a circuit substrate 2 and a protective element 3 mounted on the circuit substrate 1. This protective circuit substrate 1 is incorporated in a battery pack of a lithium ion secondary battery to constitute a part of a current path, and when an abnormality such as over-charging and over-discharging is detected, blows a meltable conductor 13 of the protective element 3 to interrupt the current path.

Protective Element

As shown in FIG. 1 (A), the protective element 3 includes an insulating substrate 11, a heat-generating element 14 laminated on the insulating substrate 11 and covered with an insulating member 15, a first and a second electrodes 12 (A1), 12 (A2) formed on the both ends of the insulating substrate 11, a heat-generating element extracting electrode 16 laminated on the insulating member 15 and overlapping the heat-generating element 14, and a meltable conductor 13 the both ends of which are connected to the first and second electrodes 12 (A1), 12 (A2), respectively, and the central portion of which is connected to the heat-generating element extracting electrode 16.

The insulating substrate 11 is formed by using an insulating material such as alumina, glass ceramic, mullite and zirconia. Other materials used for printed circuit boards such as glass epoxy substrate or phenol substrate may be used as the insulating substrate 11; in these cases, however, the temperature at which the fuses are blown should be considered. The insulating substrate 11 may be formed in an approximately rectangular shape as shown in FIG. 1 (A), for example.

The heat-generating element 14 is made of a conductive material such as W, Mo and Ru, which has a relatively high resistance and generates a heat when a current flows therethrough. A powdered alloy, composition or compound of these materials is mixed with resin binder to obtain a paste, which is screen-printed as a pattern on the insulating substrate 11 and baked to form the heat-generating element 14.

The insulating member 15 is arranged such that it covers the heat-generating element 14, and the heat-generating element extracting electrode 16 is disposed so as to face the heat-generating element 14 via this insulating member 15. The insulating member 15 may be laminated between the heat-generating element 14 and the insulating substrate 11 so as to efficiently conduct the heat of the heat-generating element 14 to the meltable conductor 13. The insulating member 15 may be made of a glass.

It should be noted that the heat-generating element 14 may be formed on a surface of the insulating substrate 11 on which the electrodes 12 (A1), 12 (A2) are formed, as shown in FIG. 1, or may be formed on the opposing back surface 11*a* of the insulating substrate 11. In addition, the heat-generating element 14 may be formed within the insulating substrate 11. Moreover, the heat-generating element 14 may be overlapped with the heat-generating element extracting electrode 16 or the meltable conductor 13, or formed in parallel with the heat-generating element extracting electrode 16 or the meltable conductor 13 on the surface of the insulating substrate 11. In any case, the heat-generating element 14 is coated with the insulating member 15 when insulation from surroundings is required and may not be coated with the insulating member 15 when such insulation is not required.

One end of the heat-generating element extracting electrode 16 is connected to the heat-generating element electrode 18 (P1) and is continuous with one end of the heat-generating element 14. The other end of the heat-generating element 14 is connected to the other heat-generating element electrode 18 (P2). It should be noted that the heat-generating element electrode 18 (P1) is formed at the side of a third edge 11*d* of the insulating substrate 11 and the heat-generating element electrode 18 (P2) is formed at the side of a fourth edge 11*e* of the insulating substrate 11. In addition, as shown in FIG. 2, the heat-generating element electrode 18 (P2) is connected to the external connecting electrode 21 (P2) formed on the back surface 11*a* of the insulating substrate 11 via a half through-hole 20 formed at the fourth edge 11*e*.

The meltable conductor 13 is formed from a low melting point metal, such as Pb free solder consisting essentially of Sn, capable of being promptly melted by a heat of the heat-generating element 14. In addition, the meltable conductor 13 may be formed by using a high melting point metal such as In, Pb, Ag, Cu or an alloy consisting essentially of any one of these, or may have a laminated structure of a low melting point metal and a high melting point metal.

It should be noted that the meltable conductor 13 is connected to the heat-generating element extracting electrode 16 and the electrodes 12 (A1), 12 (A2) by soldering, for example. The meltable conductor 13 can be easily connected by reflow soldering.

Figure 2:
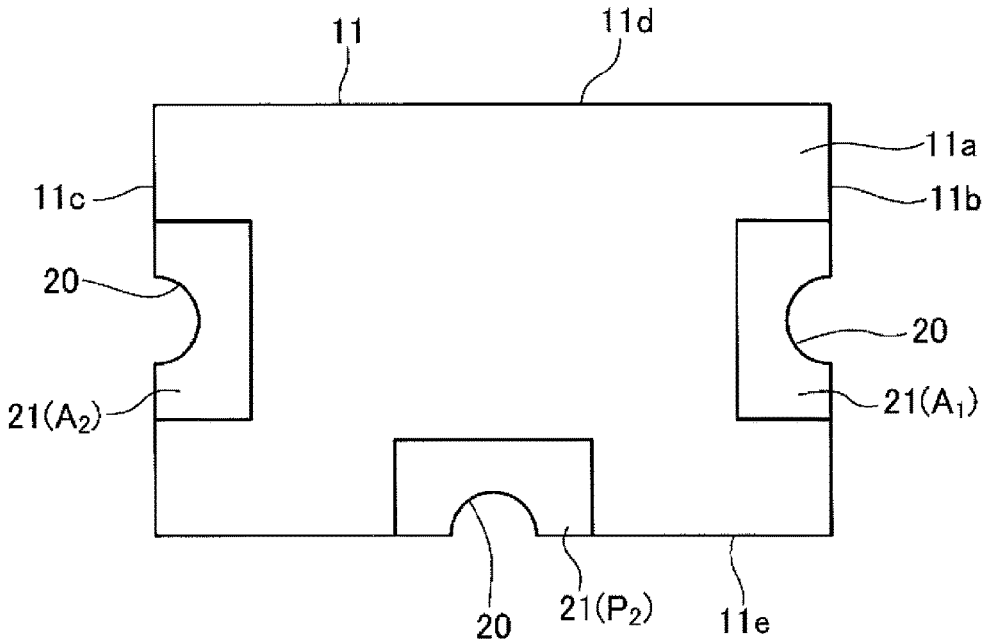
FIG. 2 is a rear view of the protective element.

As shown in FIG. 2, the first electrode 12 (A1) and the second electrode 12 (A2) formed on the both side edges of the insulating substrate 11 and connected by the meltable conductor 13 are connected to a first and a second external connecting terminals 21 (A1), 21 (A2) formed in the back surface 11*a* of the insulating substrate 11 via the half through-hole 20, respectively. The protective element 3 is incorporated as a part of a current path by connecting the external connecting terminals 21 (A1), 21 (A2) to connecting electrodes 25 (A1), 25 (A2) provided on the circuit substrate 2 as described below.

The half through-holes 20, having a conductive layer on the inner wall thereof, electrically connect the first electrode 12 (A1) to the first external connecting terminals 21 (A1), and the second electrode 12 (A2) to the second external connecting terminals 21 (A2). The half through-holes 20 are formed at the first edge 11*b* of the insulating substrate 11 on which the first electrode 12 (A1) is formed, and the second edge 11*c* on which the second electrode 12 (A2) is formed. The conductive layer on the inner wall of the half through-hole 20 can be formed by filling a conductive paste therein.

The first electrode 12 (A1) is provided at the edge portion of the first edge 11*b* of the insulating substrate 11 formed in a rectangular shape. In addition, the first electrode 12 (A1) is placed at an inner position relative to the both ends of the first edge 11*b* of the insulating substrate 11. This constitution of the protective element 3 can separate the first electrode 12 (A1) from the outer edge of the insulating substrate 11 as far as possible, and can prevent the heat generated by the heat-generating element 14 from conducting to the circuit substrate 2 via the first electrode 12 (A1) or to the surroundings, thus improving the high-speed blowout property of the meltable conductor 13.

Thus, the heat generated by the heat-generating element 14 is also conducted to the first electrode 12 (A1) via the meltable conductor 13 and is also dissipated from the first electrode 12 (A1). It is necessary for the protective element 3 to promptly blow the meltable conductor 13 and interrupt the current path when an abnormality occurs in an electronic appliance, and it is therefore required to suppress dissipation of the heat of the heat-generating element 14 from the first electrode 12 (A1) so as to raise the temperature of the meltable conductor 13 to the melting temperature thereof. Since a large part of the heat of the first electrode 12 (A1) is dissipated from the outer edge of the insulating substrate 11, the first electrode 12 (A1) of the protective element 3 is placed at an inner position relative to the both ends of the first edge 11*b* of the insulating substrate 11 so as to separate the first electrode 12 (A1) from the outer edge of the insulating substrate 11 as far as possible. This constitution of the protective element 3 can prevent the heat generated by the heat-generating element 14 from being conducted to the circuit substrate 2 via the first electrode 12 (A1) or dissipated to the surroundings.

In addition, the first electrode 12 (A1) may be placed around the central portion C1 of this first edge 11*b* of the insulating substrate 11. Thus, the electrode area of the first electrode 12 (A1) can be made small such that heat capacity is reduced, and the heat dissipating path is restricted to the half through-hole 20, thereby further suppressing the heat-dissipation from the first electrode 12 (A1).

Through-Hole

The half through-hole 20 connecting the first electrode 12 (A1) to the first external connecting terminals 21 (A1) is formed at the central portion C1 of the first edge 11*b* of the insulating substrate 11. Compared to the constitution in which the half through-hole 20 is offset towards one side of the first edge 11*b* (see FIG. 19), this constitution can make the heat dissipating path shorter and prevent the heat of the heat-generating element 14 from spreading to the first electrode 12 (A1), thus efficiently concentrating the heat of the heat-generating element 14 into the meltable conductor 13.

In the protective element 3, the substrate center, which is farthest from the outer edge of the insulating substrate 11 and from which heat from the heat-generating element 14 escapes least, attains the highest temperature. In accordance with this substrate center, by forming the through-hole 20 at the central portion C1 of the first edge 11*b* of the insulating substrate 11, the heat dissipating path is not spread to the first electrode 12 (A1) or the first edge 11*b* on which the first electrode 12 (A1) is formed, thus enabling concentration of the heat of the heat-generating element 14 into the meltable conductor 13.

In this situation, as described above, by also forming the first electrode 12 (A1) at the central portion C1 of the first edge 11*b* of the insulating substrate 11, the heat capacity of the first electrode 12 (A1) can be suppressed and dissipation of the heat spread to the first electrode 12 (A1) is also suppressed, thereby reducing the heat-dissipation from the heat-generating element 14.

Explanation of the first electrode 12 (A1) described above is also applicable to the second electrode 12 (A2). Consequently, the second electrode 12 (A2) is placed at an inner position relative to the both ends of the second edge 11*c* of the insulating substrate 11, and preferably around a central portion C2 of this second edge 11*c* of the insulating substrate 11.

This constitution of the second electrode 12 (A2) can prevent the heat generated by the heat-generating element 14 from conducting to the circuit substrate 2 via the second electrode 12 (A2) or to the surroundings, thus improving the high-speed blowout property of the meltable conductor 13, and the heat dissipating path is restricted to the half through-hole 20, thereby further suppressing the heat-dissipation from the second electrode 12 (A2).

Similarly, the half through-hole 20 provided to the second electrode 12 (A2) is also formed at the central portion C2 of the second edge 11*c* of the insulating substrate 11. Compared to the constitution in which the half through-hole 20 is offset towards one side of the first edge 1, this constitution can make the heat dissipating path shorter and prevent the heat of the heat-generating element 14 from spreading to the second electrode 12 (A2), thus efficiently concentrating the heat of the heat-generating element 14 into the meltable conductor 13.

Position of Meltable Conductor 13

In addition, the meltable conductor 13 is preferably provided on the center line C0 of the insulating substrate 11 connecting the respective central portions C1, C2 of the first edge 11*b* and the second edge 11*c* of the insulating substrate 11. The meltable conductor 13 is thus placed on the central region of the insulating substrate 11 which will be heated to the highest temperature, and the heat of the heat-generating element is efficiently conducted to and promptly blows the meltable conductor 13.

It should be noted that the meltable conductor 13 may be offset from the center line C0 of the insulating substrate 11 as long as it is connected between the first and second electrodes 12 (A1), 12 (A2). In this case, heat-dissipation from the first electrode 12 (A1) and the second electrode 12 (A2) is also suppressed and the meltable conductor 13 is efficiently heated by the heat of the heat-generating element 14 and promptly blown. In addition, multiple meltable conductors 13 may be provided between the first and second electrodes 12 (A1), 12 (A2), and one of these meltable conductors 13 may be placed on the center line C0 of the insulating substrate 11, or all of the meltable conductors 13 may be offset from the center line C0 of the insulating substrate 11.

It should be noted that a flux 17 may be applied on almost the entire surface of the meltable conductor 13 of the protective element 3 in order to prevent oxidation of the meltable conductor 13.

Moreover, the protective element 3 may include a covering member (not shown) over the insulating substrate 11 for internal protection.

Reference Example

Next, reference examples will be explained wherein the melting times are measured while changing positions of the first and second electrodes of the protective element. In the conventional protective element 80 shown in FIG. 19 (A) as a reference comparative example, the first and second electrodes 81, 82 are formed in regions ranging from the respective central portions of the first edge 85*a* and second edge 85*b* of the insulating substrate 85 to one end. In the protective element 80, half through-holes 90, 91 to be connected to connecting electrodes of a circuit substrate are offset towards one side end of the first edge 85*a* and second edge 85*b*, respectively. This prevents accidental 180 degree misalignment in mounting of the protective element 80.

In contrast, in the protective element 3 of a reference example, the first and second electrodes 12 (A1), 12 (A2) and the half through-holes 20 are formed at respective central portions C1, C2 of the first edge 11*b* and second edge 11*c* of the insulating substrate 11 (see FIG. 1). Other components of the protective element 80 are the same as those of the protective element 3.

Comparing melting times of the meltable conductors 13, 83 by supplying 10 W of electric power to the respective heat-generating elements of the protective elements of the reference example and reference comparative example revealed that the melting time of the meltable conductor 83 of the protective element 80 according to the reference comparative example was 1.5 sec while the melting time of the meltable conductor 13 of the protective element 3 according to the reference example was 1.2 sec, exhibiting an excellent high-speed blowout property.

This is because the protective element 80 of the reference comparative example dissipated more heat of the heat-generating element 84 since the first and second electrodes 81, 82, being formed in regions ranging from the respective central portions of the first edge 85*a* and second edge 85*b* of the insulating substrate 85 to one end, have larger area exposing outwardly from the outer edges of the insulating substrate 85. In addition, in the protective element 80 of the reference comparative example, since the half through-holes 90, 91 having a large heat capacity are offset towards one side of one edge 85*a* and the other edge 85*b* of the insulating substrate 85, the heat dissipating path of the heat-generating element 84 is enlarged and thus temperature increase in the meltable conductor 83 is inhibited.

On the other hand, in the protective element 3 of the reference example, the first and second electrodes 12 (A1), 12 (A2) and half through-holes 20 are formed at respective central portions C1, C2 of the first edge 11*b* and the second edge 11*c* of the insulating substrate 11. In this case, the heat dissipating path was therefore limited and the heat of the heat-generating element 14 was not easily dissipated via the first and second electrodes 12 (A1), 12 (A2) and the half through-holes 20, but the heat of the heat-generating element 14 was preferentially conducted to the meltable conductor 13, thus heating the meltable conductor 13 to the melting temperature promptly.

Circuit Substrate

First Embodiment

Figure 3:
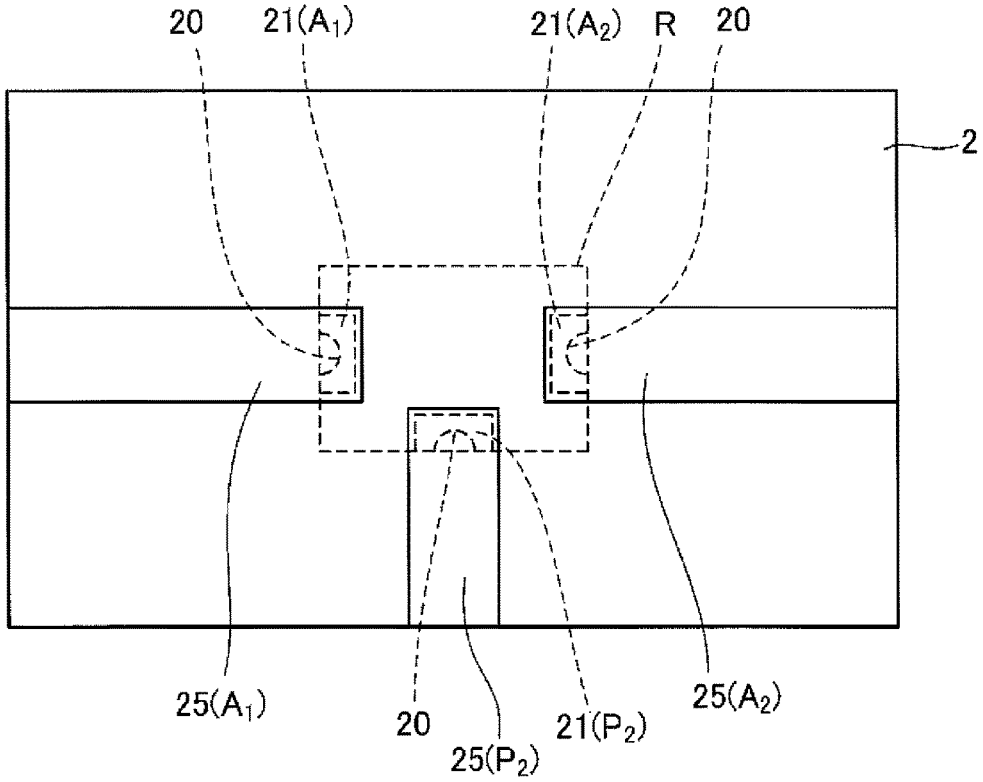
FIG. 3 is a plan view illustrating a circuit substrate of a protective circuit substrate according to an embodiment of the present invention.

Next, the circuit substrate 2 to which the protective element 3 is connected will be explained. The circuit substrate 2 may be any conventional insulating substrate including a glass epoxy substrate or a glass substrate, a rigid substrate such as a ceramic substrate, and a flexible substrate having a mounting region R onto which the protective element 3 is mounted, as shown in FIG. 3, and connecting electrodes for connecting to the protective element 3 are provided in the mounting region R. The mounting region R has a shape and area approximately the same as those of the insulating substrate 11 of the protective element 3. It should be noted that, an element such as an FET is mounted to the circuit substrate 2 for providing current to the heat-generating element 14 of the protective element 3.

The mounting region R has the same area as the insulating substrate 11 of the protective element 3, and connecting electrodes 25 (A1), 25 (A2) and 25 (P2) connected respectively to external connecting terminals 21 (A1), 21 (A2) and 21 (P2) formed on a back surface 11*a* of the insulating substrate 11 are formed in the mounting region R. In addition, except for the connecting electrodes 25 (A1), 25 (A2) and 25 (P2) necessary for connection to the protective element 3, no other electrode pattern unnecessary for connection to the protective element 3 is formed in the mounting region R.

Since the mounting region R constituted as above includes an electrode pattern having a large heat capacity to the extent necessary for mounting the protective element 3, heat-dissipation from the back surface 11*a* of the insulating substrate 11 can be suppressed. The protective circuit substrate 1 therefore can efficiently conduct the heat of the heat-generating element 14 to the meltable conductor 13. Consequently, the protective circuit substrate 1 can promptly blow the meltable conductor 13 to interrupt the current path when an abnormality such as over-charging and over-discharging is detected.

The connecting electrodes 25 (A1), 25 (A2) have a width wider than that of the external connecting terminals 21 (A1), 21 (A2), thus reducing the contact resistance with the protective element 3. However, wide connecting electrodes 25 (A1), 25 (A2) provided in the mounting region R of the protective element 3 will absorb heat from the heat-generating element 14 to inhibit prompt melting of the meltable conductor 13. In addition, in the case that the insulating substrate 11 of the protective element 3 is made of a ceramic, if a corner portion of the ceramic substrate contacts the connecting electrodes 25 (A1), 25 (A2), heat will escape therefrom; the width of the connecting electrodes 25 (A1), 25 (A2) is preferably narrower than that of the first and second edge 11*b*, 11*c* of the insulating substrate 11 so as to avoid contacting the corner portion of the insulating substrate 11 even if the protective element 3 is mounted at a tilted angle. In view of the above, the connecting electrodes 25 (A1), 25 (A2) are preferably formed to a width approximately the same as that of the external connecting terminals 21 (A1), 21 (A2).

Example 1

Figure 4:
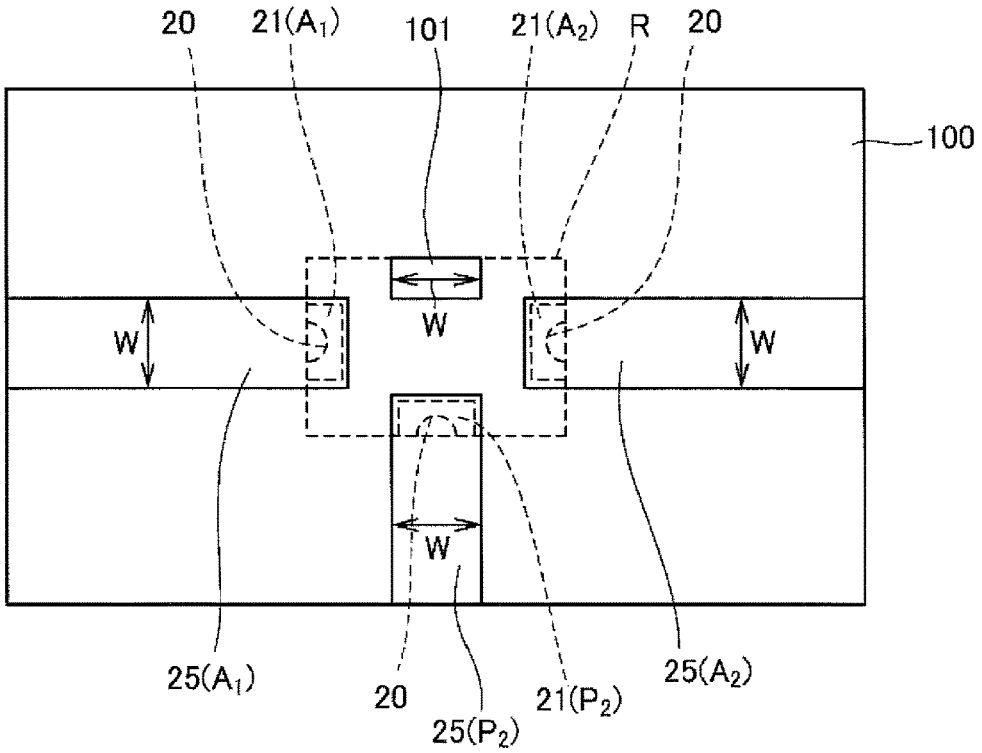
FIG. 4 is a plan view illustrating a circuit substrate of a comparative example.

Next, a first example will be explained. In this first example, melting times of each of the meltable conductors are measured for a protective circuit substrate having a dummy electrode provided in the mounting region R of the circuit substrate 2 and a protective circuit substrate without the dummy electrode. As shown in FIG. 4 circuit substrate 100 of Comparative example 1 includes, within the mounting region R, a dummy electrode 101 as well as the connecting electrodes 25 (A1), 25 (A2) and 25 (P2) connected to the external connecting terminals 21 (A1), 21 (A2), 21 (P2) of the protective element 3. The line width W of the connecting electrodes 25 (A1), 25 (A2), 25 (P2) and the dummy electrode 101 is 2 mm. The circuit substrate 2 of Example 1 has a constitution almost the same as the Comparative example 1 except for that only the connecting electrodes 25 (A1), 25 (A2) and 25 (P2) are provided in the mounting region R (see FIG. 3). In addition, the protective element 3 described above was used as the protective elements for Example 1 and Comparative example 1.

By supplying 10 W of electrical power to each of the heat-generating elements 14 of the protective elements 3 of Example 1 and Comparative example 1 and comparing the melting times of the meltable conductors 13, it was revealed that, compared to melting time of the meltable conductor 13 of the protective element 3 of Comparative example 1 being 18 sec, melting time of the meltable conductor 13 of the protective element 3 of Example 1 was 1.2 sec, showing a superior high-speed blowout property.

This is because, in the protective element of Comparative example 1, the dummy electrode 101 provided within the mounting region R conducted more heat of the heat-generating element 14 to the back surface of the circuit substrate 100, and the heat was not preferentially conducted to the meltable conductor 13. In contrast, Example 1 only includes, within the mounting region R, a minimum connecting electrode 25 necessary for mounting the protective element 3, and unnecessary patterns having a large heat capacity are not provided beneath the protective element 3. The protective circuit substrate of Example 1 therefore could suppress heat-conduction downward from the insulating substrate 11 and the heat of the heat-generating element 14 could be efficiently conducted to the meltable conductor 13, thus improving high-speed blowout property.

When providing a current of 5 A to the protective circuit substrates of Example 1 and Comparative example 1, the temperature of the protective element 3 of Comparative example in which the dummy electrode 101 was formed in the mounting region R for heat-dissipation was measured to be 59° C. On the other hand, the temperature of the protective element 3 of Example 1 having no dummy electrode in the mounting region R was measured to be 60° C., which was slightly higher than that of Comparative example 1, but this increase is acceptable in actual use.

Example 2

Next, a second example will be explained. In the second example, melting times of each of the meltable conductors 13 are measured for a protective circuit substrate in which a dummy electrode not contributing to mounting of the protective element 3 was formed both inside and outside the mounting region R, and a protective circuit substrate in which a dummy electrode was formed outside the mounting region R.

Figure 5:
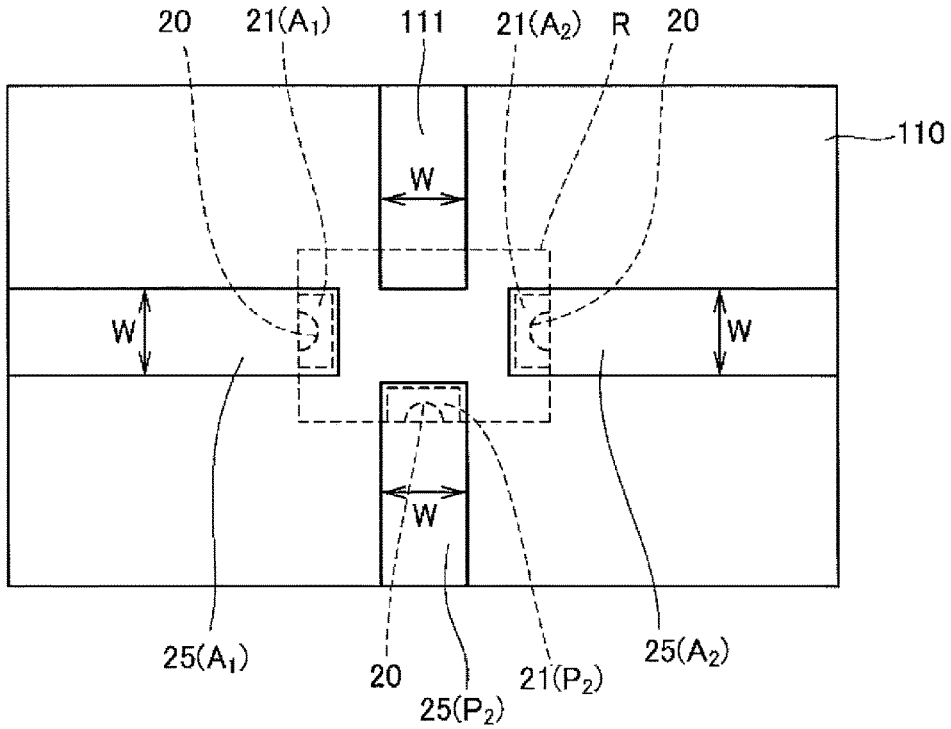
FIG. 5 is a plan view illustrating a circuit substrate of a comparative example.
Figure 6:
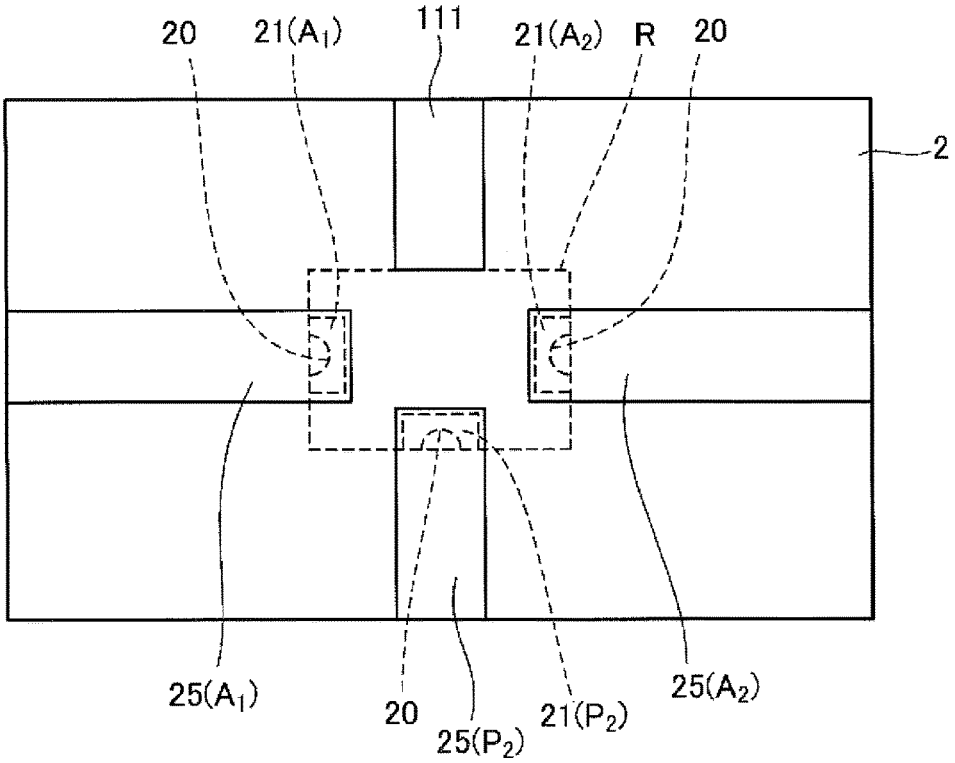
FIG. 6 is a plan view illustrating a circuit substrate of a protective circuit substrate according to an embodiment of the present invention.

As shown in FIG. 5 circuit substrate 110 of Comparative example 2 includes, within the mounting region R, a dummy electrode 111 as well as the connecting electrodes 25 (A1), 25 (A2) and 25 (P2) connected to the external connecting terminals 21 (A1), 21 (A2), 21 (P2) of the protective element 3. The dummy electrode 111 is formed both inside and outside the mounting region R. The line width W of the connecting electrodes 25 (A1), 25 (A2), 25 (P2) and the dummy electrode 111 is 2 mm. The circuit substrate 2 of Example 2 has a constitution almost the same as the Comparative example 2 except for that only the connecting electrodes 25 (A1), 25 (A2) and 25 (P2) are provided in the mounting region R and the dummy electrode 111 is formed only outside the mounting region R, as shown in FIG. 6. In addition, the protective element 3 described above was used as the protective elements for Example 2 and Comparative example 2.

By supplying 10 W of electrical power to each of the heat-generating elements 14 of the protective elements 3 of Example 2 and Comparative example 2 and comparing the melting times of the meltable conductors 13, it was revealed that, compared to melting time of the meltable conductor 13 of the protective element 3 of Comparative example 2 being 2.5 see, melting time of the meltable conductor 13 of the protective element 3 of Example 2 was 1.3 sec, showing a superior high-speed blowout property.

It will be appreciated that the elongated dummy electrode 111 formed both inside and outside the mounting region R, as shown in FIG. 5, also promotes heat-dissipation, and inhibits preferential heat-conduction to the meltable conductor 13 and high-speed blowout property thereof.

When providing a current of 5 A to the protective circuit substrates of Example 2 and Comparative example 2, the temperature of the protective element 3 of Comparative example in which dummy electrode 111 was formed in the mounting region R for heat-dissipation was measured to be 58° C. On the other hand, the temperature of the protective element 3 of Example 2 having no dummy electrode in the mounting region R was measured to be 59° C., which was slightly higher than that of Comparative example 2, but this increase is acceptable in actual use.

Width of Connecting Electrode

As shown in FIG. 3 and FIG. 6, the connecting electrodes 25 (A1), 25 (A2) and 25 (P2) are formed to have the same width as the external connecting terminals 21 (A1), 21 (A2) and 21 (P2) of the protective element 3 to be connected. By this width, the circuit substrate 2 can minimize the area of the electrode pattern having a large heat capacity within the mounting region R, suppress heat-dissipation from the protective element 3 and efficiently heat and blow the meltable conductor 13.

Second Embodiment

Alternatively, the connecting electrodes 25 (A1), 25 (A2) of the circuit substrate 2 may have a width outside the mounting region R wider than the width inside the mounting region R. For example, as shown in FIG. 7, in the circuit substrate 2, the width W1 of the connecting electrodes 25 (A1), 25 (A2) inside the mounting region R may be formed to be the same as the width of the external connecting terminals 21 (A1), 21 (A2) of the protective element 3, and the width W2 outside the mounting region R may be formed to be the same as the width of the first and second edges 11*b*, 11*c* of the insulating substrate 11.

Therefore, in the circuit substrate 2, forming the width of the connecting electrodes 25 (A1), 25 (A2) inside the mounting region R as narrow as the width of the external connecting terminals 21 (A1), 21 (A2) of the protective element 3 can minimize the electrode size formed under the protective element 3 and suppress the heat-dissipation therefrom. In addition, in the circuit substrate 2, widening the width of the connecting electrodes 25 (A1), 25 (A2) outside the mounting region R to the width approximately the same as the width of the insulating substrate 11 of the protective element 3 can increase the heat capacity of the circuit substrate 2 to realize a heat-dissipation accommodating an increased rating, and increase the rating by reducing the resistance of the connecting electrodes 25 (A1), 25 (A2) while suppressing heat-dissipation from the protective element 3.

Figure 7:
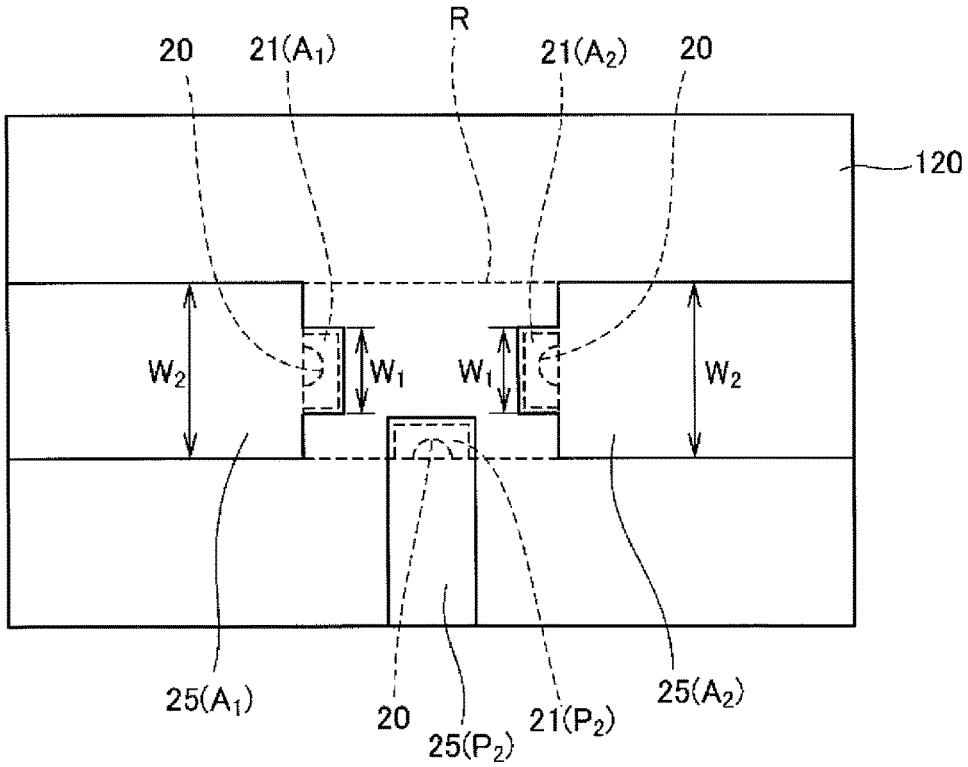
FIG. 7 is a plan view illustrating a circuit substrate of a protective circuit substrate according to an embodiment of the present invention.

For suppressing the heat-dissipation of the protective element 3, and for increasing the rating of and decreasing the resistance of the circuit substrate 2, the width of the connecting electrodes 25 (A1), 25 (A2) is preferably reduced just before the mounting region R, as shown in FIG. 7.

Example 3

Next, a third example will be explained. In the third example, two protective circuit substrates 1 respectively including connecting electrodes 25 (A1), 25 (A2) having different widths inside the mounting region R were prepared and melting times of each of the meltable conductors 13 were measured.

Figure 8:
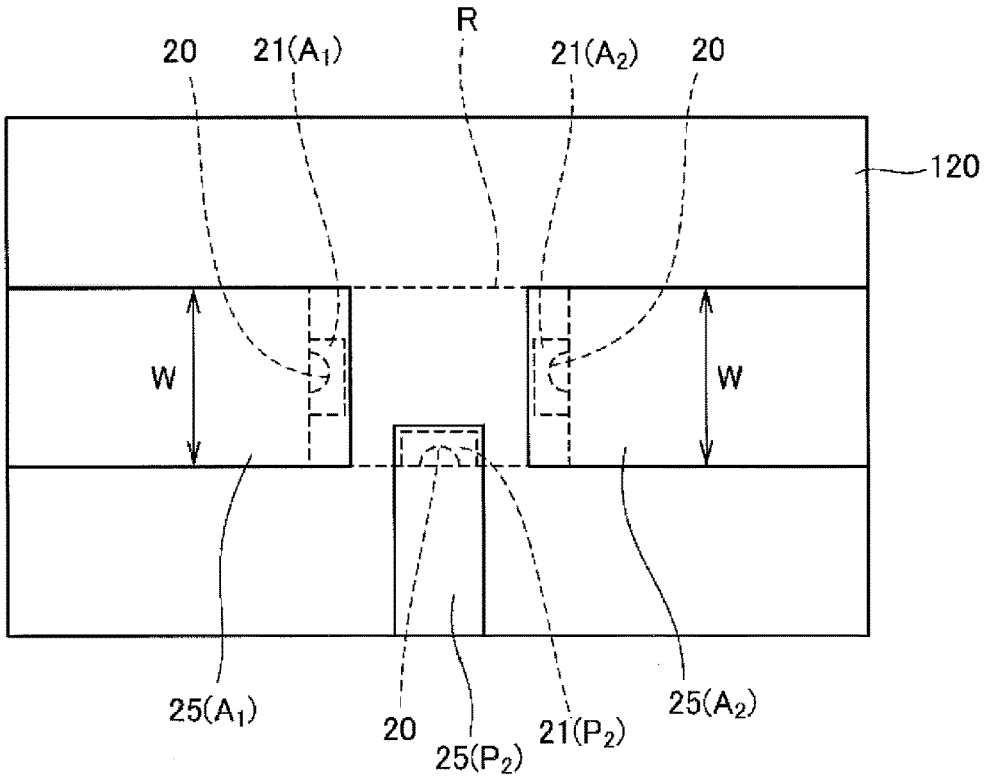
FIG. 8 is a plan view illustrating a circuit substrate of a comparative example.

As shown in FIG. 8, the width W of the connecting electrodes 25 (A1), 25 (A2) both inside and outside the mounting region R of a circuit substrate 120 of Comparative example 3 was formed to be the same width as the first and second edge 11*b*, 11*c* of the insulating substrate 11 (4 mm). On the other hand, in the circuit substrate 2 of Example 3, the width was formed to be approximately the same width as the external connecting terminals 21 (A1), 21 (A2) of the protective element 3 (2 mm) inside the mounting region R, and formed to be the same width as the first and second edge 11*b*, 11*c* of the insulating substrate 11 (4 mm) outside the mounting region R (see FIG. 7). In addition, the protective element 3 described above was used as the protective elements for Example 3 and Comparative example 3.

By supplying 10 W of electrical power to each of the heat-generating elements 14 of the protective elements 3 of Example 3 and Comparative example 3 and comparing the melting times of the meltable conductors 13, it was revealed that, compared to melting time of the meltable conductor 13 of the protective element 3 of Comparative example 3 being 3.5 sec, melting time of the meltable conductor 13 of the protective element 3 of Example 3 was 1.6 sec, showing a superior high-speed blowout property.

In addition, when providing a current of 5 A to the protective circuit substrates of Example 3 and Comparative example 3, both of the temperature of the protective element 3 of the Example 3 and that of the Comparative example 3 were measured to be 55° C.

In Comparative example 3, connecting electrodes 25 (A1), 25 (A2) were formed to be wide so that the area of the electrode pattern having a large heat capacity formed in the mounting region R of the protective element 3 was more than necessary; therefore, more heat escaped downward from the insulating substrate 11 and the heat of the heat-generating element 14 was not efficiently conducted to the meltable conductor 13. On the contrary, in Example 3, since the connecting electrodes 25 (A1), 25 (A2) were narrowed to be almost the same width as the external connecting terminals 21 (A1), 21 (A2) inside the mounting region R, heat-dissipation downward from the insulating substrate 11 was suppressed and the meltable conductor 13 was efficiently heated.

Temperature of the protective element 3 when 5 A of current flowed therethrough was 55° C. in both Example 3 and Comparative example 3 and the rate of temperature increase in the protective element 3 was equivalent, from which it was revealed that heat-dissipation under normal usage was equivalent.

In addition, when adding a coverlay covering the connecting electrodes 25 (A1), 25 (A2) except for the region within the mounting region R to be connected to the external connecting terminals 21 (A1), 21 (A2) to the constitution of Comparative example 3 for insulation, the melting time of the meltable conductor 13 when supplying 10 W of power was the same as that of the constitution without the coverlay. This revealed that adjusting exposure area of the connecting electrodes 25 (A1), 25 (A2) within the mounting region R by using a coverlay could not suppress heat-dissipation.

Example 4

Next, a fourth example will be explained. In the fourth example, protective circuit substrates 1 respectively including connecting electrodes 25 (A1), 25 (A2) having different widths inside the mounting region R were prepared and melting times of each of the meltable conductors 13 were measured in the same way as above.

Figure 19A:
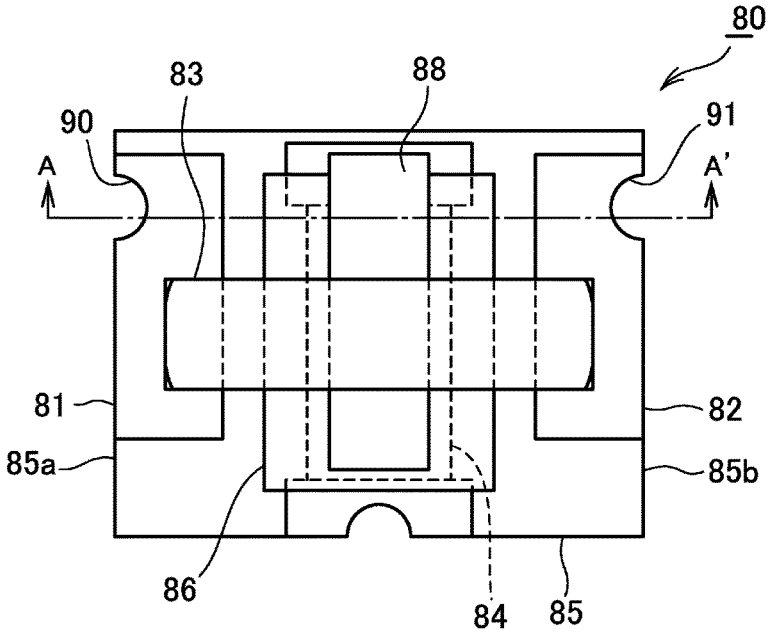
FIG. 19A RELATED ART
FIG. 19 (A) is a plan view illustrating a protective element of a protective circuit substrate of a Reference example and FIG. 19 (B) is a cross-sectional view of the protective circuit substrate.
Figure 19B:
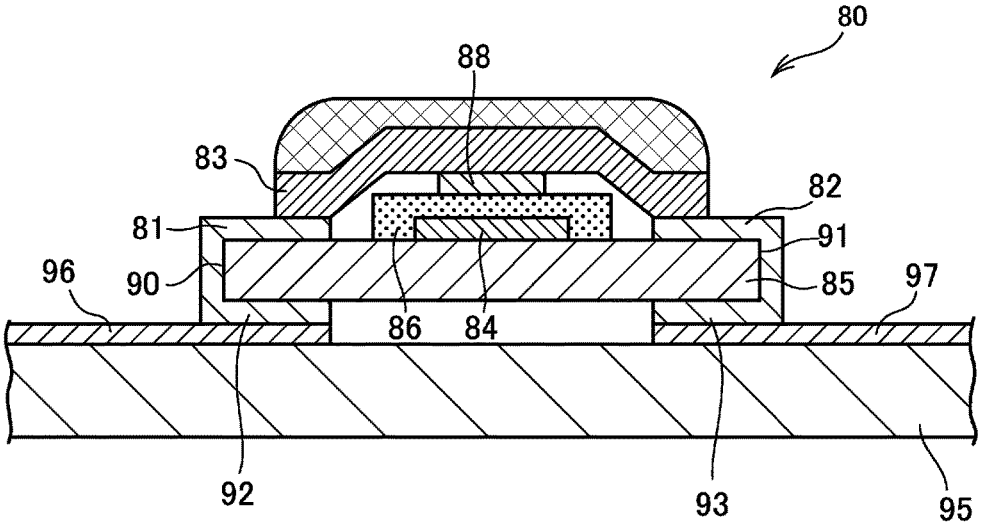
FIG. 19B RELATED ART

In this fourth example, the protective element 80 shown in FIG. 19 was used as the protective element. As described above, in the protective element 80, the first and second electrodes 81, 82 are formed in regions ranging from the respective central portions of the respective edges of the insulating substrate 85 to one end, and the half through-holes 90, 91 are offset towards one side of the edge. In addition, the protective element 80 is connected to the first and second electrodes 81, 82 via the half through-holes 90, 91, and the first and second connecting terminals 92, 93, connecting to the first and second connecting electrodes 96, 97 formed on the circuit substrate 95, are also offset towards one side of the edge on the back surface of the insulating substrate 85.

Figure 9:
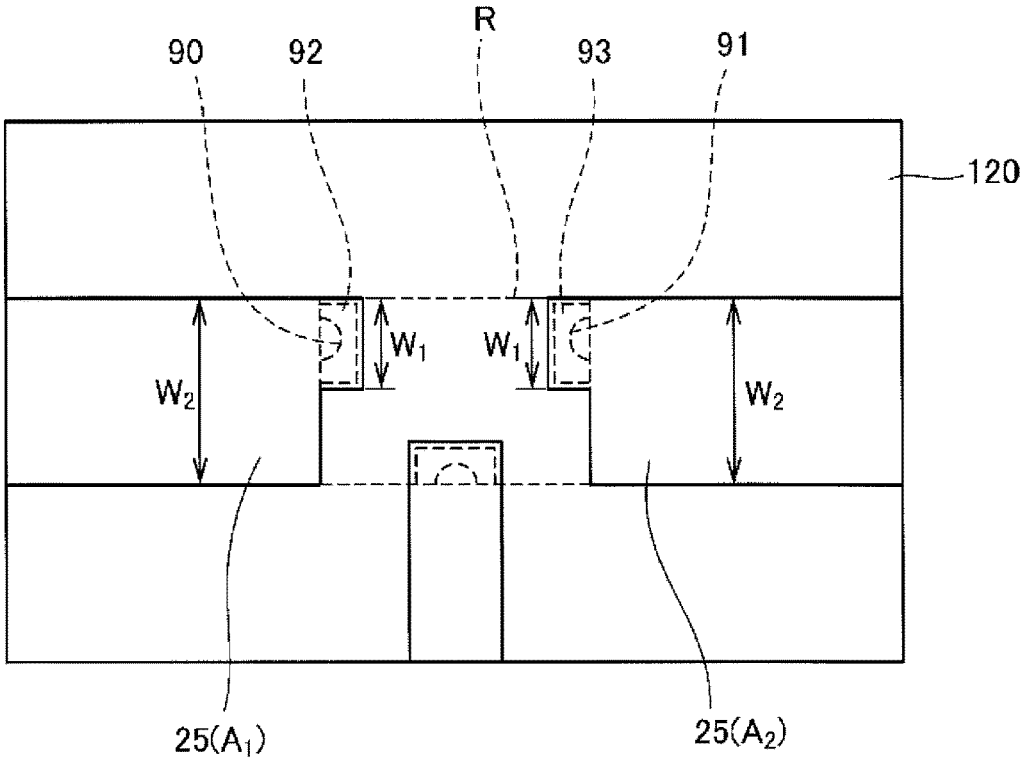
FIG. 9 is a plan view illustrating a circuit substrate of a protective circuit substrate according to an embodiment of the present invention.
Figure 10:
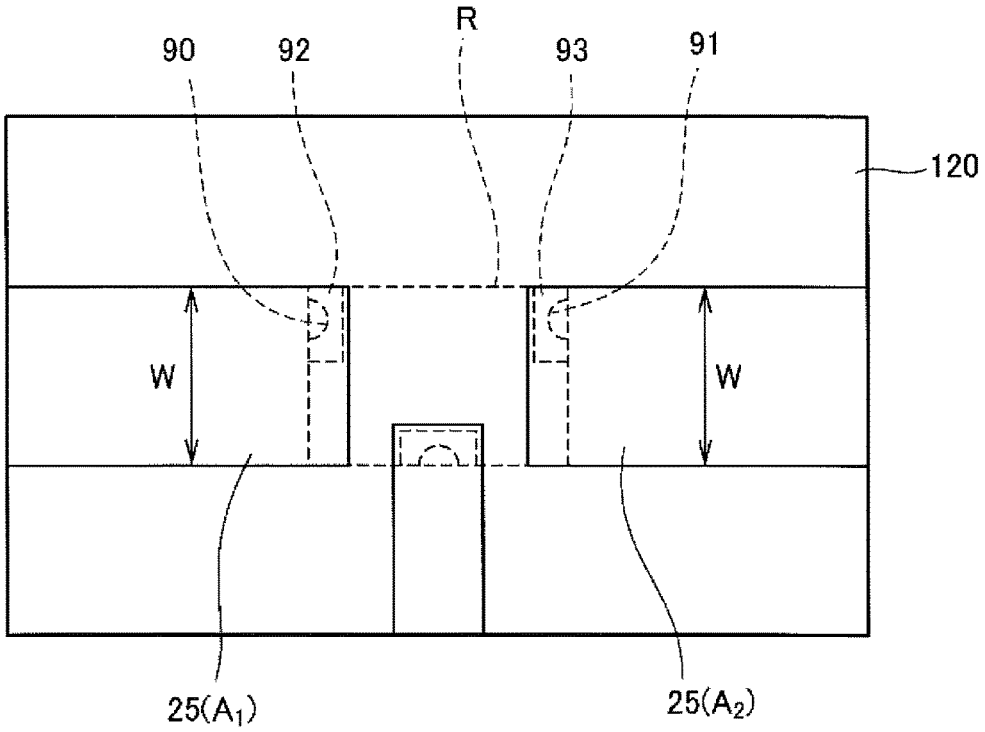
FIG. 10 is a plan view illustrating a circuit substrate of a comparative example.

As shown in FIG. 10, the width W of the connecting electrodes 25 (A1), 25 (A2) both inside and outside the mounting region R of a circuit substrate 121 of Comparative example 4 was formed to be the same width as the edge of the insulating substrate 85 on which the first and second electrodes 81, 82 were formed (4 mm). On the other hand, in the circuit substrate 2 of Example 4, the width was formed to be approximately the same width as the external connecting terminals 92, 93 of the protective element 80 (W1=2 mm) inside the mounting region R, and formed to be the same width as the edge of the insulating substrate 85 on which the first and second electrodes 81, 82 were formed (W2=4 mm) outside the mounting region R, as shown in FIG. 9.

In addition, in the circuit substrate 2 of Example 4, in accordance with the first and second connecting terminals 92, 93 of the protective element 80, the connecting electrodes 25 (A1), 25 (A2) inside the mounting region R were formed with deviation to one side of the edge on which the first and second electrodes 81, 82 were formed.

By supplying 10 W of electrical power to each of the heat-generating elements 84 of the protective elements 80 of Example 4 and Comparative example 4 and comparing the melting times of the meltable conductors 83, it was revealed that, compared to melting time of the meltable conductor 83 of the protective element 80 of Comparative example 4 being 3.9 sec, melting time of the meltable conductor 83 of the protective element 80 of Example 4 was 2.1 sec, showing a superior high-speed blowout property.

In addition, when providing a current of 5 A to the protective circuit substrates of Example 4 and Comparative example 4, the temperature of the protective element 80 of Comparative example 4 was measured to be 56° C. and that of the Example 4 was measured to be 57° C., which is slightly higher than that of Comparative example 4, but this increase is acceptable in actual use.

In Comparative example 4, as is the case of Comparative example 3, connecting electrodes 25 (A1), 25 (A2) were formed to be wide so that the area of the electrode pattern having a large heat capacity formed in the mounting region R of the protective element 80 was more than necessary; therefore, more heat escaped downward from the insulating substrate 85 and the heat of the heat-generating element 84 was not efficiently conducted to the meltable conductor 83. In addition, in Example 4, as is the case of Example 3, since the connecting electrodes 25 (A1), 25 (A2) were narrowed to be almost the same width as the external connecting terminals 21 (A1), 21 (A2) inside the mounting region R, heat-dissipation downward from the insulating substrate 85 was suppressed and the meltable conductor 83 was efficiently heated.

Temperature of the protective element 80 when 5 A of current flowed therethrough was 57° C. in both Example 4 and Comparative example 4 and the rate of temperature increase in the protective element 80 was equivalent, from which it was revealed that heat-dissipation under normal usage was equivalent.

Third Embodiment

Figure 11:
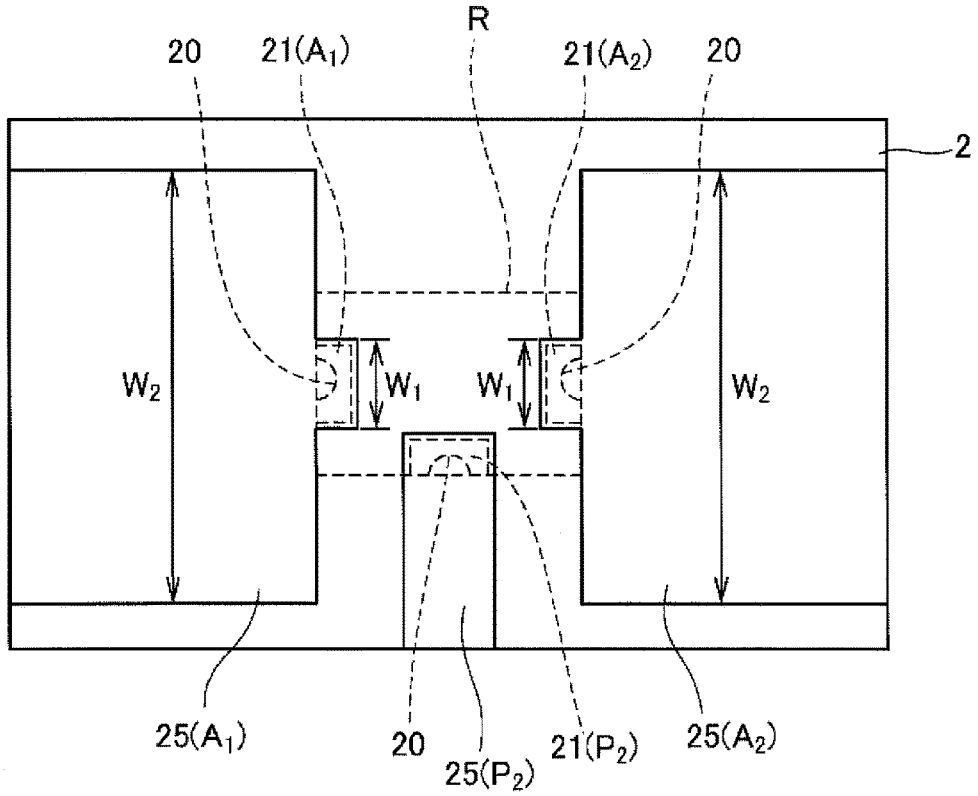
FIG. 11 is a plan view illustrating a circuit substrate of a protective circuit substrate according to an embodiment of the present invention.

Although the width W2 outside the mounting region R of the connecting electrodes 25 (A1), 25 (A2) of the embodiment described above was formed to be the same as the width of the first and second edge 11*b*, 11*c* of the insulating substrate 11, the connecting electrodes 25 (A1), 25 (A2) of the protective circuit substrate 1 may be formed over wide area on the circuit substrate 2 except for the mounting region R, as shown in FIG. 11.

For example, as shown in FIG. 11, in the circuit substrate 2, the width W1 of the connecting electrodes 25 (A1), 25 (A2) inside the mounting region R may be formed to be the same as the width of the external connecting terminals 21 (A1), 21 (A2) of the protective element 3, and the width W2 outside the mounting region R may be formed to be as wide as the width of the circuit substrate 2.

The protective circuit substrate 1 thus can suppress heat-generation and promote heat-dissipation even in cases that current flowing therethrough is increased in accordance with increase of capacity or rating of electronic appliances. In addition to widening the connecting electrodes 25 (A1), 25 (A2) over a wide area on the circuit substrate 2 except for the mounting region R, a coverlay may be formed or a solder resist may be printed on an appropriate portion of the protective circuit substrate 1 for necessary insulation.

In this case as well, in the mounting region R of the protective element 3 of the protective circuit substrate 1, by forming the width W1 of the connecting electrodes 25 (A1), 25 (A2) to be same as the external connecting terminals 21 (A1), 21 (A2) and by forming no other unnecessary electrodes, it is possible to suppress heat-dissipation downward from the insulating substrate 11 and to efficiently heat the meltable conductor 13.

Example 5

Figure 12:
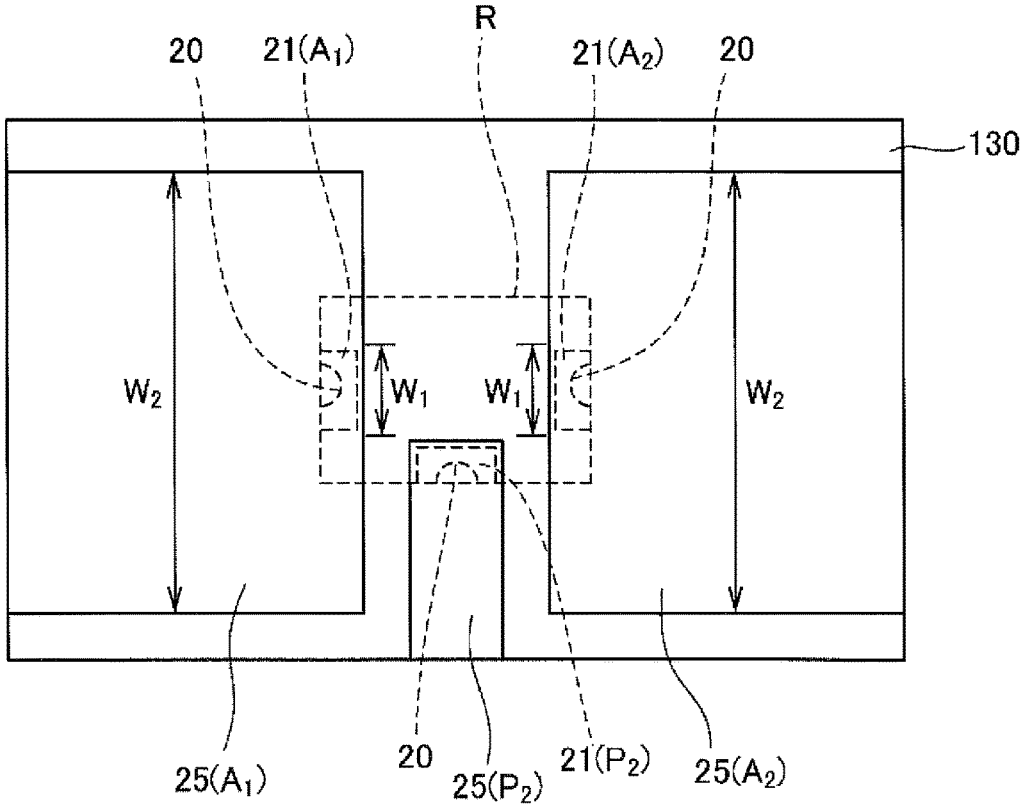
FIG. 12 is a plan view illustrating a circuit substrate of a comparative example.

Next, a fifth example will be explained. As shown in FIGS. 11 and 12, the fifth example is different from the third example in that the width of the connecting electrodes 25 (A1), 25 (A2) outside the mounting region R is widened over a wide area on the circuit substrate 2.

As shown in FIG. 12, the width W of the connecting electrodes 25 (A1), 25 (A2) both inside and outside the mounting region R of a circuit substrate 130 of Comparative example 5 of this fifth example was formed over wide area across the width direction in the circuit substrate 2 (12 mm). On the other hand, as shown in FIG. 11, in the circuit substrate 2 of Example 5 of the fifth example, width W1 inside the mounting region R was formed to be approximately the same as the external connecting terminals 21 (A1), 21 (A2) of the protective element 3 (W1=2 mm) and the width outside the mounting region R was formed over a wide area across the width direction in the circuit substrate 2 (W2=12 mm). In addition, the protective element 3 described above was used as the protective elements for Example 5 and Comparative example 5.

By supplying 10 W of electrical power to each of the heat-generating elements of the protective elements 3 of Example 5 and Comparative example 5 and comparing the melting times of the meltable conductors 13, it was revealed that, compared to melting time of the meltable conductor 13 of the protective element 3 of Comparative example 5 being 5.8 sec, melting time of the meltable conductor 13 of the protective element 3 of Example 5 was 2.4 sec, showing a superior high-speed blowout property.

In addition, when providing a current of 5 A to the protective circuit substrates of Example 5 and Comparative example 5, the temperature of the protective element 3 of Example 5 was measured to be 42° C. and that of the Comparative example 5 was measured to be 41° C.

In Comparative example 5 of this fifth example as well, the area of the electrode pattern formed in the mounting region R of the protective element 3 was more than necessary; therefore, more heat escaped downward from the insulating substrate 11 and the heat of the heat-generating element 14 was not efficiently conducted to the meltable conductor 13. On the contrary, in Example 5, since the connecting electrodes 25 (A1), 25 (A2) were narrowed to be almost the same width as the external connecting terminals 21 (A1), 21 (A2) inside the mounting region R, heat-dissipation downward from the insulating substrate 11 was suppressed and the meltable conductor 13 was efficiently heated.

Temperature of the protective element 3 when 5 A of current flowed therethrough was 420° C. in Example 5 and 41° C. in Comparative example 5 and the rate of temperature increase in the protective element 3 was equivalent, from which it was revealed that heat-dissipation under normal usage was equivalent.

Figure 13:
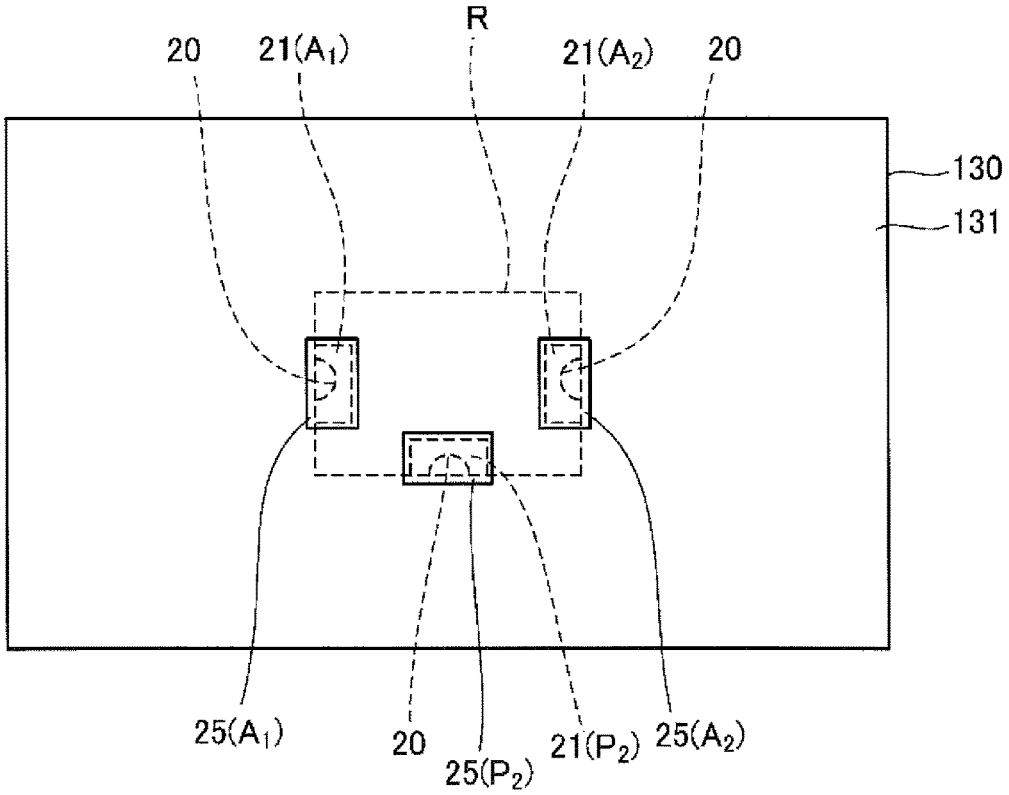
FIG. 13 is a plan view illustrating a circuit substrate of a comparative example.

In addition, when adding a coverlay covering the connecting electrodes 25 (A1), 25 (A2) except for the region within the mounting region R to be connected to the external connecting terminals 21 (A1), 21 (A2), 21 (P2) to the constitution of Comparative example 5 for insulation, as shown in FIG. 13, the melting time of the meltable conductor 13 when supplying 10 W of power was 5.7 sec, which was the same as that of the constitution without the coverlay (see FIG. 12). This revealed that adjusting exposure area of the connecting electrodes 25 (A1), 25 (A2) and 25 (P2) within the mounting region R by using a coverlay could not suppress heat-dissipation.

Temperature of the protective element 3 when 5 A of current flowed therethrough was 41° C. in Comparative example 5 and the temperature increased to 43° C. when the coverlay was added, from which it was revealed that the coverlay 131 slightly degraded heat-dissipation property during use.

Fourth Embodiment

Figure 14:
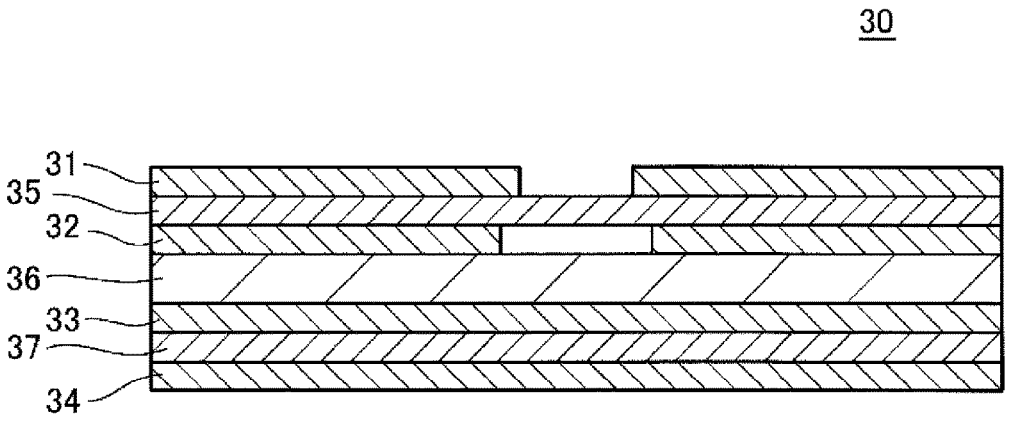
FIG. 14 is a cross-sectional view illustrating a circuit substrate of a protective circuit substrate according to an embodiment of the present invention.
Figure 15:
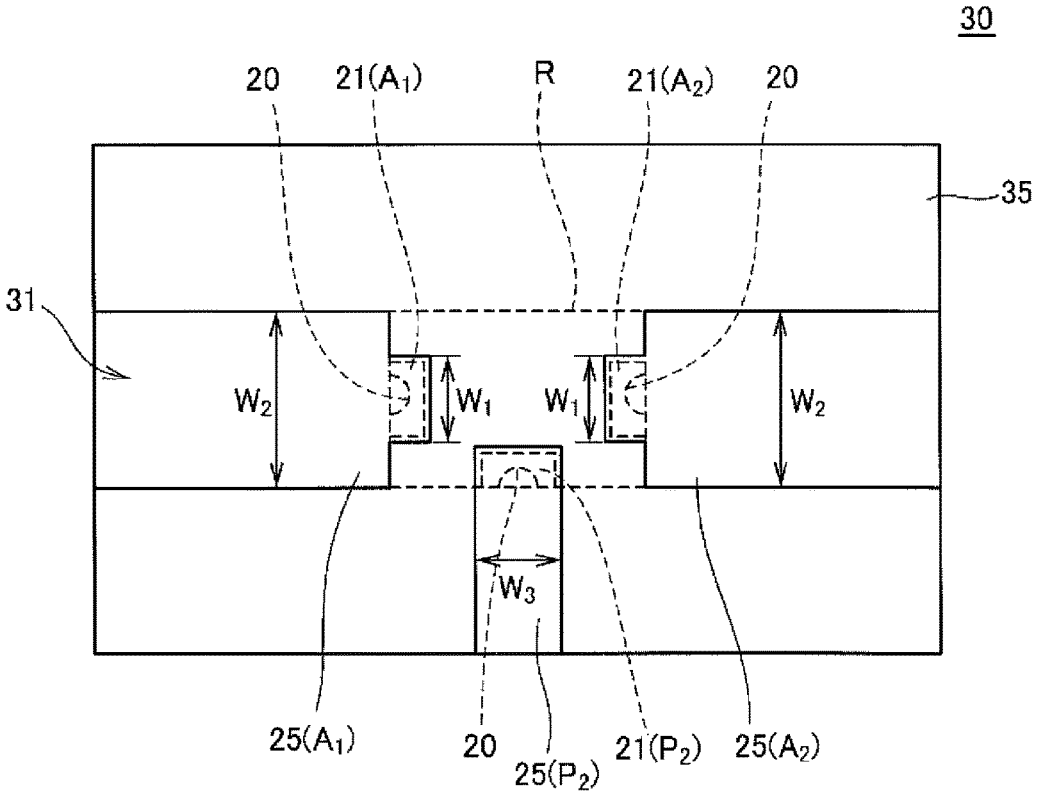
FIG. 15 is a plan view illustrating a circuit substrate of a protective circuit substrate according to an embodiment of the present invention and to a comparative example.
Figure 16:
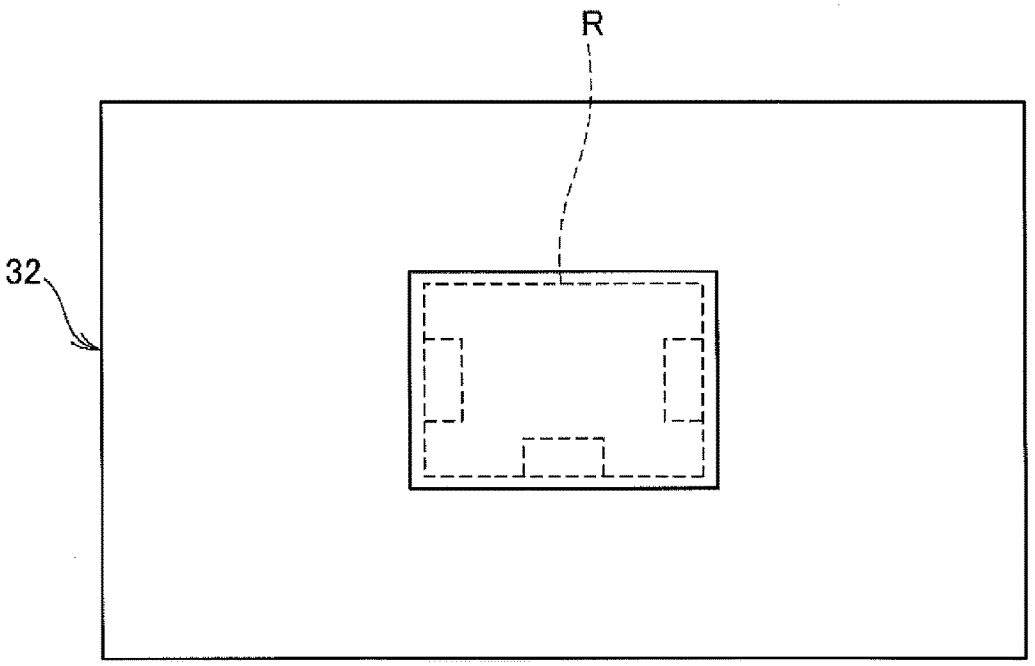
FIG. 16 is a plan view of a second conductive layer of a circuit substrate of a protective circuit substrate according to an embodiment of the present invention.

In addition, the protective circuit substrate 1 may be formed as a multi-layer structure by laminating a plurality of conductive layers via insulating layers to form the circuit substrate 2 and omit conductive patterns beneath the mounting region R. For example, as shown in FIG. 14, the circuit substrate may be formed as a multi-layered laminated plate 30 formed by laminating glass epoxy substrates on which a copper foil is attached. As shown in FIG. 15, the first conductive layer 31 on which the protective element 3 is mounted has patterned connecting electrodes 25 (A1), 25 (A2), 25 (P2). As shown in FIG. 16, conductive patterns within the projecting plane of the mounting region R have been removed from the second conductive layer 32 directly under the first conductive layer 31.

In this protective element 3, because no electrode patterns having a large heat capacity are not provided beneath the mounting region R other than the connecting electrode 25 (A1), 25 (A2), 25 (P2) necessary for mounting, heat-dissipation downward from the insulating substrate 11 is suppressed. The protective circuit substrate 1 can therefore conduct the heat of the heat-generating element 14 to the meltable conductor 13 and promptly blowout the meltable conductor 13.

It should be noted that, a first insulating layer 35 provided between a first conductive layer 31 and a second conductive layer 32, and a second insulating layer 36 provided between a second conductive layer 32 and a third conductive layer 33 are made of a material having a small heat capacity such as a glass epoxy substrate, such that they do not promote heat-dissipation even in cases where they exist beneath the mounting region R. In addition, in the circuit substrate 2, it is desirable to remove conductive layers within the projecting plane of the mounting region R from the third conductive layer 33 and any further conductive layers as well as the second conductive layer 32, so as to suppress heat-dissipation.

Example 6

Next, a sixth example will be explained. In the sixth example, circuit substrates 30 in which four conductive layers 31 to 34 were laminated to form a four-layer substrate having a thickness of 0.8 mm were prepared and a circuit substrate in which conductive patterns within the projecting plane of the mounting region R were removed from the second layer 32 (FIG. 15, Example 6), and a circuit substrate in which conductive patterns were formed over the entire surface of the second layer 32 including the projecting plane of the mounting region R (Comparative example 6) were formed and the melting times of respective meltable conductors 13 were measured.

As shown in FIG. 14, the circuit substrate 2 used in Example 6 and Comparative example 6 includes, in the order starting from the top layer onto which the protective element 3 is mounted, a first conductive layer 31 comprising a Cu pattern having a thickness of 35 μm, a first insulating layer 35 comprising a glass epoxy substrate having a thickness of 0.1 mm, a second conductive layer 32 comprising a Cu pattern having a thickness of 12 μm, a second insulating layer 36 comprising a glass epoxy substrate having a thickness of 0.6 mm, a third conductive layer 33 comprising a Cu pattern having a thickness of 12 μm, a third insulating layer 37 comprising a glass epoxy substrate having a thickness of 0.1 mm, and a fourth conductive layer 34 comprising a Cu pattern having a thickness of 35 μm.

Furthermore, as shown in FIG. 15, in Example 6 and Comparative example 6, connecting electrodes 25 (A1), 25 (A2), 25 (P2) were formed on the first conductive layer. The width W1 of the connecting electrode 25 (A1), 25 (A2) inside the mounting region R is formed to be approximately the same as the external connecting terminal 21 (A1), 21 (A2) of the protective element 3 (W1=2 mm), and the width W2 outside the mounting region R is formed to be approximately the same as the first and second edge 11*b*, lie of the insulating substrate 11 (W2=4 mm). In addition, the width W3 of the connecting electrode 15 (P2) both inside and outside the mounting region R is formed to be approximately the same as the external connecting terminal 21 (P2) of the protective element 3 (W3=2 mm).

As shown in FIG. 16, in Example 6, the Cu pattern of the second layer 32 within the projecting plane of the mounting region R is removed. It should be noted that, in Example 6, each of the Cu patterns of the third conductive layer 33 and the fourth conductive layer 34 are formed over the entire surface of the glass epoxy substrate of the third insulating layer 37 including the projecting plane of the mounting region R.

On the other hand, in Comparative example 6, each of the Cu patterns of the second conductive layer 32, the third conductive layer 33 and the fourth conductive layer 34 are formed over the entire surface of the glass epoxy substrate of the second insulating layer 36 and the third insulating layer 37 including the projecting plane of the mounting region R. In addition, the protective element 3 described above was used as the protective elements for Example 6 and Comparative example 6.

By supplying 10 W of electrical power to each of the heat-generating elements 14 of the protective elements 3 of Example 6 and Comparative example 6 and comparing the melting times of the meltable conductors 14, it was revealed that, compared to melting time of the meltable conductor 14 of the protective element 3 of Comparative example 6 being 4.0 sec, melting time of the meltable conductor 13 of the protective element 3 of Example 6 was 3.2 sec, showing a superior high-speed blowout property.

In addition, when providing a current of 5 A to the protective circuit substrates of Example 6 and Comparative example 6, both of the temperature of the protective element 3 of the Example 6 and that of the Comparative example 6 are measured to be 40° C.

This is because, in Example 6, the Cu pattern of the second conductive layer 32 within the projecting plane of the mounting region R is removed such that, beneath the protective element 3 mounted onto the mounting region R, other than the connecting electrode 25 (A1), 25 (A2), 25 (P2) formed in the first conductive layer 31, no electrode pattern having a large heat capacity is formed until the second conductive layer 32. Since nearly instantaneous heat-generation of the heat-generating element 14 tends to spread in vertical direction relative to the insulating substrate 11 and Example 6 includes only a minimum necessary electrode pattern vertically, vertical heat-dissipation is suppressed to a minimum level such that the meltable conductor 13 can be efficiently heated.

Method of Using Protective Circuit Substrate

Figure 17:
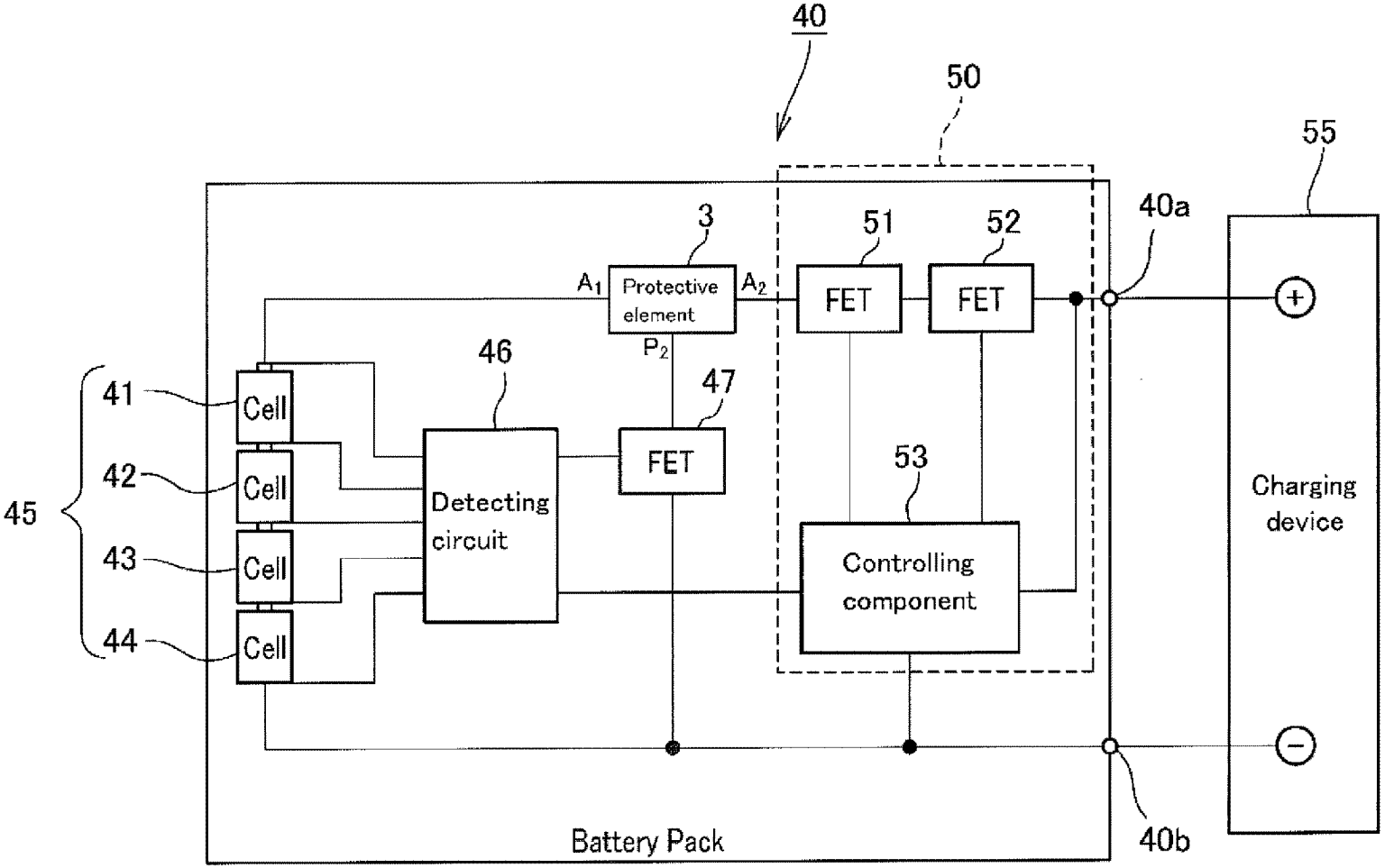
FIG. 17 is a circuit diagram of a battery pack.

Next, a method of using the protective circuit substrate 1 will be explained. The above-described protective circuit substrate 1 is used as, for example, a circuit within a battery pack of a lithium ion secondary battery as shown in FIG. 17.

For example, the protective element 3 is incorporated in a battery pack 40 including a battery stack 45 comprising four battery cells 41 to 44 in total in a lithium ion secondary battery.

The battery pack 40 includes: a battery stack 45; a charging/discharging controlling circuit 50 for controlling charging/discharging of the battery stack 45; a protective element 3 according to the present invention for interrupting charging when an abnormality is detected in the battery stack 45; a detection circuit 46 for detecting a voltage of each battery cell 41 to 44; and a current controlling element 47 for controlling the operation of the protective element 3 in accordance with the detection result of the detection circuit 46.

The battery stack 45, comprising battery cells 41 to 44 connected in series and requiring a control for protection from over-charging or over-discharging state, is removably connected to a charging device 55 via an anode terminal 40*a* and a cathode terminal 40*b* of the battery pack 40, and the charging device 55 applies charging voltage to the battery stack 45. The battery pack 40 charged by the charging device 55 can be connected to a battery-driven electronic appliance via the anode terminal 40*a* and the cathode terminal 40*b* and supply electric power to the electronic appliance.

The charging/discharging controlling circuit 50 includes the two current controlling elements 51, 52 connected to the current path from the battery stack 45 to the charging device 55 in series, and the controlling component 53 for controlling the operation of these current controlling elements 51, 52. The current controlling elements 51, 52 are formed of a field effect transistor (hereinafter referred to as FET) and the controlling component 53 controls the gate voltage to switch the current path of the battery stack 45 between a conducting state and an interrupted state. The controlling component 53 is powered by the charging device 55 and, in accordance with the detection signal from the detecting circuit 46, controls the operation of the current controlling elements 51, 52 to interrupt the current path when over-discharging or over-charging occurs in the battery stack 45.

The protective element 3 is connected in a charging/discharging current path between the battery stack 45 and the charging/discharging controlling circuit 50, for example, and the operation thereof is controlled by the current controlling element 47.

The detecting circuit 46 is connected to each battery cell 41 to 44 to detect voltage value of each battery cell 41 to 44 and supplies the detected voltage value to a controlling component 53 of the charging/discharging controlling circuit 50. Furthermore, when an over-changing voltage or over-discharging voltage is detected in one of the battery cells 41 to 44, the detecting circuit 46 outputs a control signal for controlling the current controlling elements 47.

When the detection signal output from the detection circuit 46 indicates a voltage exceeding the predetermined threshold value corresponding to over-discharging or over-charging of the battery cells 41 to 44, the current controlling element 47, which is formed of an FET, for example, activates the protective element 3 to interrupt the charging/discharging current path of the battery stack 45 without the switching operation of the current controlling element 51, 52.

Particular arrangement of the protective element 3 in the battery pack 40 constituted as above will be explained below.

Figure 18:
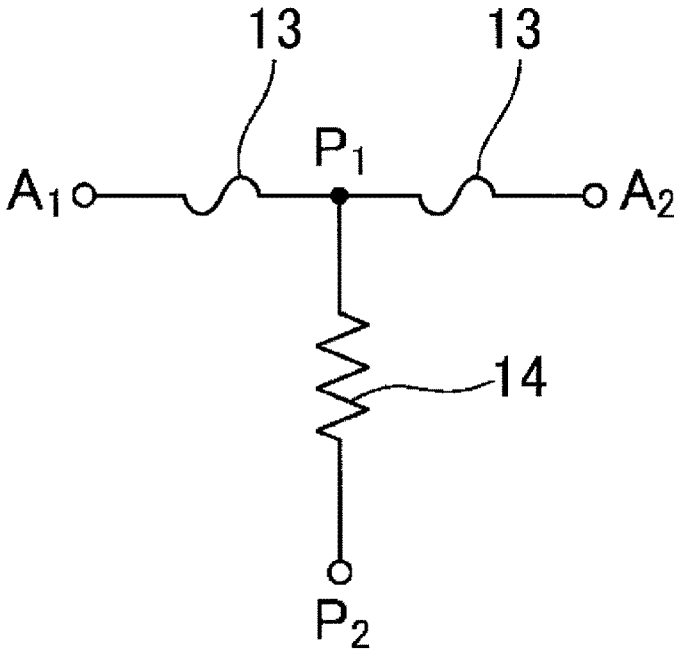
FIG. 18 is a circuit diagram of a protective element.

FIG. 18 shows an illustrative circuit arrangement of the protective element 3 according to the present invention. As shown, the protective element 3 includes a meltable conductor 13 connected in series via the heat-generating element extracting electrode 16 and a heat-generating element 14 through which a current flows via a connecting point to the meltable conductor 13 and which generates heat to melt the meltable conductor 13. Furthermore, in the protective element 3, the meltable conductor 13 is directly connected in the charging/discharging current path and the heat-generating element 14 is serially connected to the current controlling element 47. The protective element 3 includes two electrodes 12, one being connected to A1 and the other being connected to A2, via the external connecting terminal 21, respectively. In addition, the heat-generating element extracting electrode 16 and the heat-generating element electrode 18 connected thereto are connected to P1 and the other heat-generating element electrode 18 is connected to P2 via the external connecting terminal 21.

In the protective element 3 having this circuit arrangement, the meltable conductor 13 in the current path can be certainly blown by the heat generated by the heat-generating element 14. In addition, since only minimum electrode pattern necessary for mounting is formed in the mounting region R of the circuit substrate 2, and no unnecessary electrode patterns having a large heat capacity are provided beneath the protective element 3, heat-dissipation in the direction normal with the insulating substrate 11 of the protective element 3 is suppressed, such that heat of the heat-generating element 14 can be efficiently conducted to the meltable conductor 13. The protective circuit substrate 1 can therefore promptly melt the meltable conductor 13.

Those skilled in the art will appreciate that the protective element according to the present invention is not limited to usage in battery packs of lithium ion secondary batteries but may be applied to any other application requiring interruption of a current path by an electric signal.

REFERENCE SIGNS LIST

1 protective circuit substrate, 2 circuit substrate, 3 protective element, 11 insulating substrate, 11*a* back surface, 11*b* first edge, 11*c* second edge, 11*d* third edge, 12 electrode, 13 meltable conductor, 14 heat-generating element, 15 insulating member, 16 heat-generating element extracting electrode, 17 flux, 18 heat-generating element electrode, 20 half through-hole, 21 external connecting terminal, 25 connecting electrode, 30 laminated plate, 31 top layer, 32 second layer, 33 third layer, 40 battery pack, 41 to 44 battery cell, 45 battery stack, 46 detection circuit, 47 current controlling element, 50 charging/discharging controlling circuit, 51, 52 current controlling element, 53 controlling unit, 55 charging device

The invention claimed is:

1. A protective circuit substrate having a circuit substrate and a protective element mounted on the circuit substrate, the protective element comprising:

an insulating substrate;

a heat-generating element formed on the insulating substrate;

a first and a second electrodes laminated on the insulating substrate;

a first connecting terminal provided on one side edge of a mounting surface of the insulating substrate to be mounted to the circuit substrate, the first connecting terminal being continuous with the first electrode;

a second connecting terminal provided on another side edge of the mounting surface, the second connecting terminal being continuous with the second electrode;

a heat-generating element extracting electrode provided in a current path between the first and second electrodes and electrically connected to the heat-generating element; and a meltable conductor laminated on a region extending from the heat-generating element extracting electrode to the first and second electrodes and for interrupting the current path between the first electrode and the second electrode by being melted by heat;

wherein the circuit substrate includes a mounting region for mounting the protective element in which no electrode pattern other than a connecting electrode to the protective element is provided beneath the protective element, wherein the circuit substrate has a first connecting electrode and a second connecting electrode respectively connected to the first and second connecting terminals, wherein, outside a mounting region where the protective element is mounted, the first and second connecting electrodes have a first width equal to or wider than a width of the side edges of the insulating substrate on which the first and second connecting terminals are provided and, inside the mounting region, the first and second connecting electrodes have a second width narrower than the width of the side edges of the insulating substrate on which the first and second connecting terminals are provided.

2. The protective circuit substrate according to claim 1, wherein the first width of the first and second connecting electrodes is wider than a width of the first and second connecting terminals.

3. The protective circuit substrate according to claim 1, wherein the circuit substrate includes a dummy electrode provided outside the mounting region.

4. The protective circuit substrate according to claim 1, wherein the circuit substrate is a multi-layered substrate, and conductive patterns are removed across one or more layers beneath the protective element.

5. The protective circuit substrate according to claim 1, wherein, in the protective element, the first and second electrodes and the first and second connecting terminals are made continuous with each other via a through-hole formed on the central portion of a side edge on which the first and second electrodes are provided.

* * * * *